United States Patent [19]

Reaver

[11] Patent Number: 4,704,745

[45] Date of Patent: Nov. 10, 1987

[54] GARMENT FASTENER ATTACHMENT FOR BRASSIERE STRAP

[76] Inventor: Phyllis E. Reaver, Rt. 1, 240; Lake Valley Road, Hendersonville, Tenn. 37075

[21] Appl. No.: 13,724

[22] Filed: Feb. 9, 1987

[51] Int. Cl.[4] ..... A41D 27/26

[52] U.S. Cl. ..... 2/268; 2/323

[58] Field of Search ..... 128/510; 2/268, 2, 323, 2/DIG. 6; 24/300, 371, 442, 443, 519

[56] References Cited

U.S. PATENT DOCUMENTS

| | | | |
|---|---|---|---|
| 2,719,303 | 10/1955 | Londonius | 2/323 |
| 4,575,874 | 3/1986 | Johnson | 2/268 |
| 4,612,935 | 9/1986 | Greifer | 2/268 |

*Primary Examiner*—Doris L. Troutman

*Attorney, Agent, or Firm*—Harrington A. Lackey

[57] ABSTRACT

A fastener device attached to the shoulder strap of a foundation garment, such as a brassiere, for securing the undersurface of an overlying outer garment worn over the shoulder straps to conceal the shoulder strap from view.

9 Claims, 9 Drawing Figures

GARMENT FASTENER ATTACHMENT FOR BRASSIERE STRAP

BACKGROUND OF THE INVENTION

This invention relates to a fastener device for securing an undergarment to an outer garment, and more particularly to an outer garment fastener attachment for a shoulder strap on a foundation garment.

Heretofore, there has been a tendency of the shoulder strap of a brassiere or other foundation garment to become exposed where the outer garment includes a wide neckline or is loose-fitting, or for other reasons tends to shift laterally along the shoulder away from the neck.

One solution to the above problem is for the wearer to wear a strapless brassiere.

It is also known to attach the shoulder strap to a posture-corrective strap designed to fit over the shoulder caps of the wearer in order to brace the shoulders, as disclosed in the Williams U.S. Pat. No. 3,008,468 issued Nov. 14, 1961, and the Williams U.S. Pat. No. 3,027,898 issued Apr. 3, 1962.

Furthermore, cooperating fastener elements including a plurality of monofilament hook elements cooperating with a plurality of monofilament loop elements, better known under the trademark "VELCRO", are well-known for a variety of fastening and attachment uses, including fastening uses for various types of garments or fabrics. However, in order for the "VELCRO" fastener elements to properly function in a conventional manner, both the hook elements and the loop elements must be employed and cooperate with each other in order to secure the two parts to which the fastener elements are connected. As a matter of fact, the advertising packages and labels for many of the "VELCRO" fastener elements include cautionary language to the effect that the fastener must be closed when not in use and during cleaning because the hook half will tend to snag on some fabrics. The obvious connotation is that such snagging is objectionable.

SUMMARY OF THE INVENTION

It is therefore an object of this invention to provide a fastener device which is attachable to the shoulder strap of a foundation garment, and particularly a brassiere, which fastener device is adapted to engage or grip the undersurface of an overlying outer garment, to conceal the shoulder strap beneath the outer garment.

The fastener device made in accordance with this invention is secured to the shoulder strap preferably by a sleeve member adapted to longitudinally and slidably receive the shoulder strap, not only for assembly and disassembly with respect to the shoulder strap, but also for positioning the fastener device upon the shoulder strap to a desired location. Preferably, the fastener device is positioned along the shoulder strap directly on top of the shoulder for corresponding engagement with the overlying outer garment.

The fastener device is preferably in the form of a fastener strip having a top surface covered with a myriad of filament hook elements, such as the hook elements of a "VELCRO" fastener. The exposed hook elements on the fastener strip are adapted to catch, grip, or snag the fibers in the undersurface of the overlying outer garment, and particularly such outer garments which have loose fibers, such as wool, jersey, and any type of knitted material.

For very smooth or "slick" materials, such as silk or non-porous cotton, the hook elements of the fastener strip may not readily attach. In such cases, a garment attachment strip having a bottom surface covered with a myriad of filament loop elements, such as the loop elements of a "VELCRO" fastener, may be secured to the undersurface of the outer garment in a position for cooperation with the hook elements in the faster strip on the shoulder strap.

In another form of the invention, the fastener strip incorporating the hook elements may be permanently secured to the shoulder strap, preferably by stitching.

Furthermore, the fastener strips are longer than they are wide, and their lengths may vary in accordance with the type of outer garment to be worn and the degree of activity of the wearer.

DESCRIPTION OF THE PREFERRED EMBODIMENTS

Figure 1:
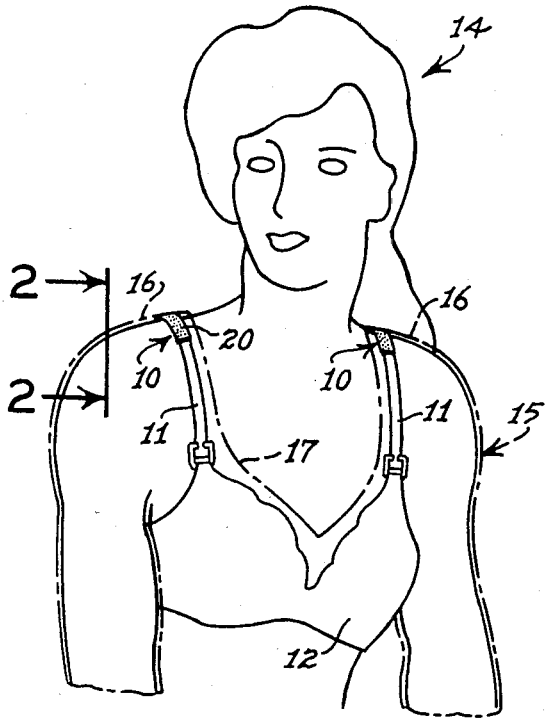
FIG. 1 is a front elevation of a woman wearing a brassiere having garment fastener attachments secured to the shoulder straps, and illustrating the neckline of an outergarment in phantom.

Referring now to the drawings in more detail, FIGS. 1—4 disclose a preferred embodiment of the garment fastener attachment 10 made in accordance with this invention.

As best disclosed in FIG. 1, the garment fastener attachment 10 is mounted or assembled upon the corresponding shoulder straps 11 of a foundation garment, such as the disclosed brassiere 12 mounted upon the torso of a woman 14. An outer garment, such as the dress 15 illustrated in phantom lines in FIG. 1, is worn by the woman 14. The outer garment 15 is provided with shoulder portions 16 which extend over and cover the fastener attachments 10 as well as the shoulder straps 11, and define a neckline 17.

Figure 2:
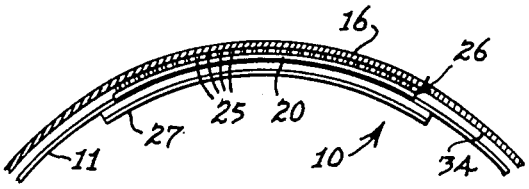
FIG. 2 is an enlarged fragmentary section taken along the line 2—2 of FIG. 1, and further illustrating the engaged outer garment portion in section.
Figure 3:
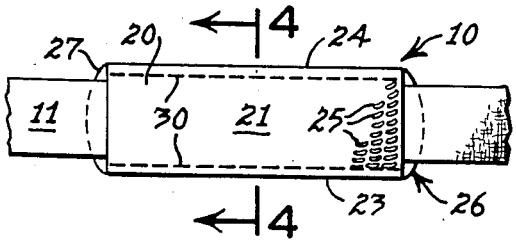
FIG. 3 is a fragmentary top plan view of the fastener strip mounted upon the shoulder strap of FIG. 2, with the corresponding portion of the outer garment removed.
Figure 4:
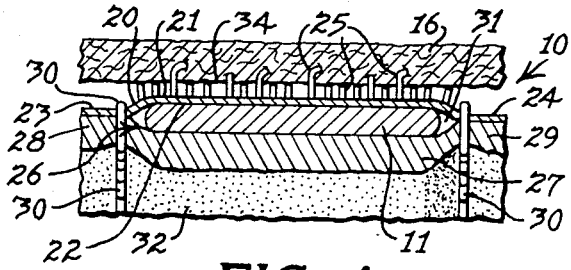
FIG. 4 is an enlarged fragmentary section taken along the line 4—4 of FIG. 3, with the overlying portion of the outer garment included.

As best illustrated in FIGS. 2–4, each fastener attachment 10 includes an elongated fastener strip 20 having a top surface 21, a bottom surface 22, and elongated parallel side edge portions 23 and 24. Projecting upwardly and formed in the top surface are a plurality, or more aptly, a multitude, or myriad, of miniature filament or monofilament hook elements 25.

The fastener strip 20 is secured longitudinally on top of the shoulder strap 11, so that when the brassiere 12 is worn the fabric strip 20 may be located on top of the shoulder of the wearer and immediately beneath, engaging and supporting the underlying surface of the corresponding shoulder portion 16 of the outer garment 15.

The particular means for securing the fastener strip 20 to the shoulder strap 11 in FIGS. 1–4 is an elongated slider strip 27 secured to the opposite edge portions 23 and 24 of the fabric strip 20 to form with the fabric strip 20 a sleeve member 26, in order to provide enough uniform cross-sectional space for longitudinally and slidably receiving the shoulder strap 11.

As disclosed in FIGS. 3 and 4, the opposite side edge portions 28 and 29 of the slider strip 27 are secured to the corresponding side edge portions 23 and 24 of the fastener strip 20 by the opposite rows of elongated stitching 30. The transverse space between the stitching 30 is slightly greater than the width of the shoulder strap 11 to permit free longitudinal slidable movement of the strap 11 within the sleeve space 31 provided between the bottom surface 22 of the fastener strip 20 and the top surface of the slider strip 27.

In a preferred form of the invention, the bottom surface of the slider strip 27 is covered with a soft fabric material 32 for a comfortable fit upon the shoulder of the wearer 14.

It is also within the scope of this invention to have a pair of longitudinally spaced transverse slots (not shown), slightly wider than the shoulder strap 11, in the fastener strip 20, for longitudinally slidably receiving the shoulder strap 11 to perform the same function as the sleeve member 26.

Moreover, the sleeve member 26 created by the slider strip 27 may be replaced by a pair of longitudinally spaced sleeve members or loops (not shown) for longitudinally and slidably receiving the strap 11, if desired.

When the fastener strip 20 is assembled upon its corresponding shoulder strap 11 and located on top of the shoulder of the wearer, beneath the shoulder portion 16 of the outergarment 15, the upward projecting hook elements 25 will sink into the undersurface 34 of the shoulder garment portion 16 and catch or become entangled with the fibers in the undersurface 34, in order to hold the shoulder portion 16 in place upon and over the shoulder strap 11. Thus, any tendency of the shoulder portion 16 of the outer garment 15 to slip, slide or shift laterally outwardly from the wearer's neck and to expose the shoulder strap 11, will be prevented.

The fastener attachment 10, as illustrated in FIGS. 1–4, has been found to be quite satisfactory for use on shoulder straps 11 of brassieres 12, because they may be easily assembled upon existing shoulder straps, as an after-market item; may be easily positioned for adjustment for various sizes of wearers, brassieres, and outer garments; and may be easily removed from the shoulder strap of one brassiere and assembled upon the shoulder strap of another brassiere or foundation garment.

Figure 5:
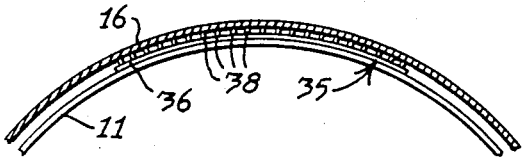
FIG. 5 is a view similar to FIG. 2, of a modified form of the fastener strip secured to the overlying outer garment.
Figure 6:
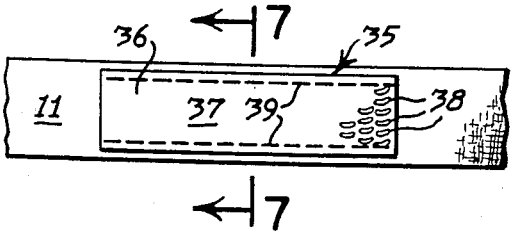
FIG. 6 is a fragmentary top plan view of the fastener strip disclosed in FIG. 5, with the overlying portion of the outer garment removed.
Figure 7:
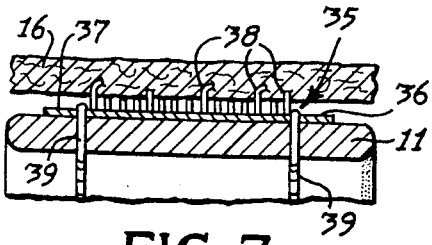
FIG. 7 is an enlarged fragmentary section taken along the line 7—7 of FIG. 6, with the overlying portion of the outer garment included.

It is also within the scope of this invention to permanently assemble fastener elements upon the shoulder staps 11, preferably by stitching. FIGS. 5–7 disclose such a modified fastener attachment 35, which includes only the fastener strip 36 having a top surface 37 from which project upwardly hook elements 38 identical to the hook elements 25. The longitudinal edge portions of the fabric strip 36 are permanently secured to the top surface of a corresponding shoulder strap 11 by longitudinal opposed pairs of stitches 39.

In FIGS. 5–7, the width of the fabric strip 36 is preferably slightly less than the width of the shoulder strap 11, so that the shoulder of the wearer 14 is protected by the softer shoulder strap 11 from the rougher texture of the fabric strip 36 and its laterally projecting hook elements 38.

It has been found that the fastener elements 10 and 35 satisfactorily catch or adhere to the undersurface 34 of an outer garment 15 when the outer garment 15 is made of most textile materials. The fastener attachments 35 have successfully adhered to outer garments 15 made of wool, knitted goods of any type material, polyester, rayon, cotton, jersey, and stretchy cotton materials. The fastener strips 20 and 36 do not readily catch or adhere to outer garments 15 made of silk or non-porous cotton, because of their slick or tightly woven fibrous surfaces. In such instances, where adherence of the fastener attachments to the outer garments is not satisfactory, a garment attachment strip 40 having a bottom surface 41 formed or covered with filament loop pile elements 42 may be secured to the undersurface 34 of the shoulder portion 16 of the outer garment 15, as disclosed in FIGS. 8 and 9.

The garment attachment strip 40 may be fixedly attached to the outer garment portion 16 by the lines of stitching 43, if desired. Although the garment attachment strip 40 may be approximately the same size as the fastener strip 20, nevertheless, it may be of a different size, either smaller or larger, longer or shorter than the fastener strip 20.

Figure 8:
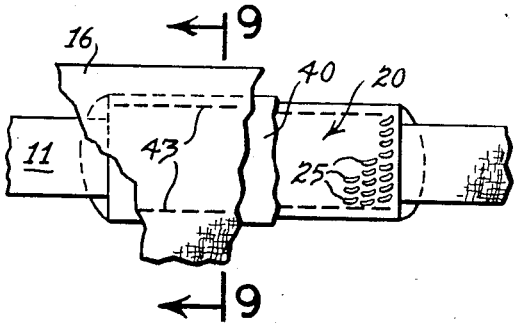
FIG. 8 is a fragmentary top plan view of a third embodiment of the invention with portions broken away.
Figure 9:
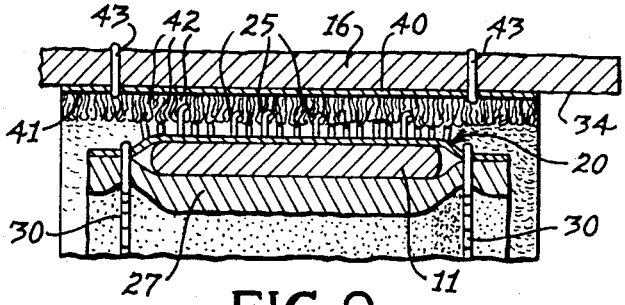
FIG. 9 is an enlarged fragmentary section taken along the line 9—9 of FIG. 8.

As illustrated in FIGS. 8 and 9, the loop pile garment fastener strip 40 is assembled in cooperation with the same hook pile fastener strip 20 illustrated in FIGS. 1–4.

Moreover, as illustrated in FIG. 9, the hook pile elements 25 are adapted to enter, engage and entangle with the loop pile elements 42 to secure the outer garment portion 16 to the shoulder strap 11, to carry out the same functions as the fastener elements 10 and 35.

The fastener elements 20 and the garment attachment strip 40 may consist of corresponding "VELCRO" fastener elements.

It is therefore apparent that the garment fastener attachments 10 and 35, as well as the fastener strip 20 and fabric attachment strip 40, satisfy a long-felt need for some means of retaining the shoulder portion 16 of an outer garment 15 over and upon the shoulder straps 11 of a foundation garment, and particularly a brassiere, to completely conceal the shoulder straps and prevent them from being exposed from the shoulder portion 16 when the outer garment 15 tends to shift laterally relative to the shoulder straps 11.

Furthermore, the garment fastener attachments 10 and 35 eliminate the necessity for the use of a strapless brassiere.

Moreover, the garment fastener attachments made in accordance with this invention are simply and inexpensively constructed, may be easily assembled, mounted, or secured to an existing shoulder strap 11 for a brassiere 12, without any modification of the brassiere, the strap, or the outer garment 15.

Furthermore, it has been found that the sleeve member 26, or the stitching 39, is the preferred means of securing the fastener strips 20 and 36 through their corresponding shoulder straps 11. It has also been found that probably the most obvious method of securing the fastener strips to the shoulder straps 11, by adhesives, is not satisfactory, because adhesives will not provide adequate adherence, and moreover, an adhesively secured fastener strip cannot be repositioned along the shoulder strap 11, removed, or remounted upon another shoulder strap.

What is claimed is:

1. A fastener device for securing a longitudinal shoulder strap of a foundation garment to the fibrous undersurface of an overlying fabric outer garment worn by the wearer, comprising:

(a) an elongated fastener strip having a top surface and a bottom surface, (b) said top surface comprising a plurality of miniature filament hook elements adapted to catch fibers in the undersurface of a fabric outer garment, (c) securing means for holding said bottom surface longitudinally upon the top surface of a longitudinal shoulder strap of a foundation garment, so that said filament hook elements will catch the loose filaments in the undersurface of a fabric outergarment overlying said shoulder strap on the shoulder of the wearer of said foundation garment, and said outer garment to conceal said shoulder strap beneath said outer garment.

2. The invention according to claim 1 in which said securing means comprises a sleeve member connected to said fastener strip longitudinally and slidably receiving said shoulder strap for adjustably positioning said fabric strip on said shoulder strap.

3. The invention according to claim 2 in which said sleeve member comprises an elongated lower slider strip connected to said fastener strip below said bottom surface to provide a space between said slider strip and said bottom surface for longitudinally and slidably receiving said shoulder strap.

4. The invention according to claim 1 in which said securing means comprises stitch means affixing said fastener strip upon said shoulder strap.

5. The invention according to claim 4 in which said shoulder strap and said fastener strip have longitudinal side edges, said stitch means comprising a pair of longitudinal stitches securing said fabric strip upon the top surface of the shoulder strap along the opposite corresponding side edges of said fastener strip and said shoulder strap.

6. The invention according to claim 5 in which the width of said fabric strip is less than the width of said shoulder strap.

7. The invention according to claim 1 further comprising a garment attachment strip having upper and lower surfaces, said lower surface comprising filament loop elements adapted to be caught by said filament hook elements when said top surface of said fastener strip engages said lower surface of said garment attachment strip, and securing means for attaching said garment attachment strip to the undersurface of an outer garment worn over the shoulder strap.

8. The invention according to claim 7 in which said garment securing means comprises stitching means for attaching said garment attachment strip to the undersurface of the outer garment opposing the shoulder strap.

9. The invention according to claim 1 further comprising an elongated shoulder strap of a foundation garment having a top surface, said securing means holding said bottom surface of said fastener strip upon the top surface of said shoulder strap.

* * * * *